US005720235A

United States Patent [19]

Bartkus

[11] Patent Number: 5,720,235

[45] Date of Patent: Feb. 24, 1998

[54] ANCHOR

[76] Inventor: Jimmie Bartkus, 3672 Tallman, SE., Grand Rapids, Mich. 49508

[21] Appl. No.: 814,678

[22] Filed: Mar. 11, 1997

[51] Int. Cl.[6] ..... B63B 21/30

[52] U.S. Cl. ..... 114/300

[58] Field of Search ..... 114/294, 295, 114/297, 300, 301

[56] References Cited

U.S. PATENT DOCUMENTS

| | | | |
|---|---|---|---|
| 53,703 | 8/1866 | Boyles . | |
| 152,175 | 6/1874 | Scanlan . | |
| D. 162,874 | 4/1951 | Polenz . | |
| D. 303,105 | 8/1989 | Stafford . | |
| D. 303,369 | 9/1989 | Abernethy . | |
| 588,767 | 8/1897 | Hoyt | 114/300 |
| 792,869 | 6/1905 | Wolff . | |
| 1,238,952 | 9/1917 | Stelzner . | |
| 1,319,419 | 10/1919 | Reynolds . | |
| 1,356,481 | 10/1920 | Windle | 114/300 |
| 2,595,966 | 5/1952 | Majors . | |
| 3,064,614 | 11/1962 | Roberts, Jr. et al. | 114/300 |
| 3,204,364 | 9/1965 | Beers . | |
| 3,520,269 | 7/1970 | Yett . | |
| 4,793,276 | 12/1988 | Stafford . | |
| 5,101,592 | 4/1992 | Merritt . | |

FOREIGN PATENT DOCUMENTS

| | | | |
|---|---|---|---|
| 326008 | 3/1930 | United Kingdom | 114/300 |
| 594287 | 11/1947 | United Kingdom . | |

*Primary Examiner*—Stephen Avila

*Attorney, Agent, or Firm*—Van Dyke, Gardner, Linn & Burkhart, LLP

[57] ABSTRACT

An anchor is provided with a base, shaft, and fastening element in the shaft for securing a line to the anchor. The base includes a plurality of outwardly facing, shovel-like indentations defined by a plurality of generally smooth, concave scooping surfaces on the top of the base. Between each shovel-like indentation is a ridge extending radially outward from the center of the base and terminating at one of the corners of base. The shovel-like indentations enable the anchor, when resting on one of its sides, to dig into the bottom of a body of water at a more upright angle and without as much tilt as prior anchors. The ridges enable the anchor to dig in to the lake-bed much like a plow when the anchor rests on one of its corners. The slope of the scooping surface in each indentation facilitates removal of mud and other debris during movement of the anchor through the water.

25 Claims, 4 Drawing Sheets

ANCHOR

BACKGROUND OF THE INVENTION

This invention relates to an improved anchor, especially for use with boats and other marine applications.

Boat anchors are used to hold boats in an essentially fixed location in a body of water. The anchors are dropped or thrown overboard with a line affixed at one end to the anchor and the other end to the boat. The anchor is lowered or allowed to sink into the water far enough to rest against the bottom of the body of water. The contact of the anchor with the bottom is primarily what enables the anchor to resist movement and remain in a set spot. Only if the anchor is dragged across the bottom of the body of water will the boat be allowed to move. Thus, the more resistance an anchor offers to being dragged across a lake bed, or the like, the more stable and better the anchor will keep the boat in a specific location.

An anchor's resistance to drag is primarily a function of two factors: its weight and its shape. The heavier the anchor, the greater the friction between the bottom, such as a lake bed, and the anchor, and the more resistant the anchor will be to movement. The shape of the anchor also plays an important role in maintaining the boat in a fixed location by enabling the anchor to dig into the lake bed. The more easily the anchor digs into the lake bed, or otherwise grabs the lake bed, the more resistant the anchor will be to movement and the better the anchor will work.

Prior art anchors, such as mushroom shaped anchors, have suffered from the disadvantage that they typically must be tipped almost completely on their side before they will begin to dig into the lake bed. To orient the anchor at such an excessive tilt angle requires that the scope of the anchor line, i.e., the amount of anchor line between the boat and the anchor, be significantly larger than if the anchor could engage the bottom properly and be nearly upright. The need for greater anchor line scope requires the additional bulk, weight and expense of the additional line itself, prevents the boat from being secured at precisely the location where the anchor was dropped, and in shifting winds, makes the boat susceptible to drifting circumferentially around the point on the lake floor where the anchor rests and into other objects or boats.

Prior art anchors have also suffered from the disadvantage that they tend to pick up debris, mud, or the like when they are hoisted. This makes the hoisting process more difficult, and also usually makes it desirable to wash the debris from the anchor after hoisting. This, of course, requires extra work. While some prior art anchors have attempted to overcome this disadvantage by including holes in the anchor, these are typically not completely effective and may reduce the resistance the anchor offers to being dragged across the lake bed. It can therefore be seen that there exists a need to provide an anchor which overcomes these and other disadvantages.

SUMMARY OF THE INVENTION

Accordingly, the present invention provides an anchor, especially for boats and other marine applications, which is highly effective in engaging and being retained in the bottom of the body of water, engages the bottom at a more upright angle enabling shorter anchor line scope, and is contoured to allow mud, debris and undesired material to wash and slide off the anchor merely through the normal motion of raising or moving the anchor through the water.

An anchor according to one aspect of the present invention includes a base having a top surface, a bottom surface, a plurality of side edges, and a center. A plurality of ridges are defined in the top surface and extend radially outwardly from the center of the top surface. The ridges each terminate at a position spaced from the center in an apex. A plurality of scooping surfaces are defined on the top surface between the ridges. The scooping surfaces slope outwardly and downwardly from the center to a respective one of the side edges. The side edges and scooping surfaces enable the anchor to dig into and be retained securely in the bottom of a body of water while also allowing debris to easily wash off the anchor upon movement through the water after being released from the bottom. The anchor also includes a connector for selective engagement with an anchor line.

According to another aspect of the present invention, the anchor includes a plurality of sides which meet and define a plurality of corners. At each corner is a triangular inclined surface which extends upwardly from the bottom surface at an angle and terminates at the apexes adjacent the corners. The ridges, apexes, and inclined surfaces at the corners allow the anchor to act in a plow-like fashion when the anchor rests on one of its corners.

According to another aspect of the present invention, the anchor includes a slightly tapering, elongated conical shaft on top of the center of the base. The ridges formed in the base have top surfaces which are generally planar and are oriented at a right angle to an axis of the conical shaft.

In its various aspects, the anchor provides several advantages over prior known anchors. When the anchor rests on its side, the shovel-like indentations allow the anchor to dig into the bottom of the body of water at less of a tilt than prior anchors. When the anchor rests on a corner, the plow-like shape formed by the ridges, corner, and inclined surfaces also allows the anchor to easily dig into the bottom and, the shape of the shovel-like indentations allows debris to easily slide off of the anchor when lifted.

These and other objects, advantages, purposes, and features of the invention will become more apparent from a study of the following description taken in conjunction with the drawings.

DESCRIPTION OF THE PREFERRED EMBODIMENTS

Figure 1:
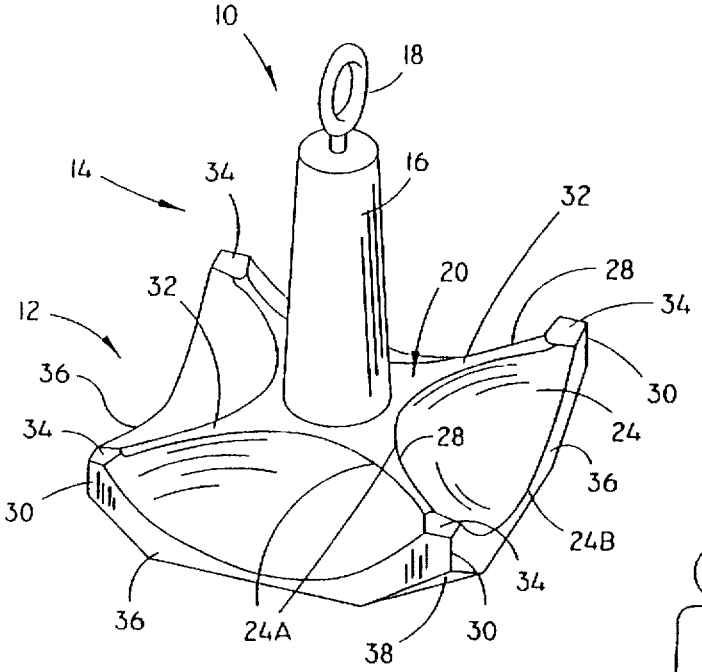
FIG. 1 is a perspective view of an anchor according to one embodiment of the present invention.

Various embodiments of the present invention will now be described with reference to the accompanying drawings wherein like reference numerals correspond to like elements in the several drawings.

An anchor 10 according to one embodiment of the present invention is depicted in FIGS. 1–6. Anchor 10 includes a base 12 and a connector 14. Connector 14 includes a slightly tapering, elongated, conical shaft 16 disposed substantially on top of and over the center of base 12. The connector tapers outwardly from top surface 17 toward its bottom with its sides preferably at a 1° angle to its central axis. Connector 14 further includes a fastening element 18, such as an eyelet, fastened through top surface 17 for selectively securing the anchor to an anchor line. Eyelet 18 is secured in shaft 16 during the molding process of anchor 10 as will be described below.

Figure 2:
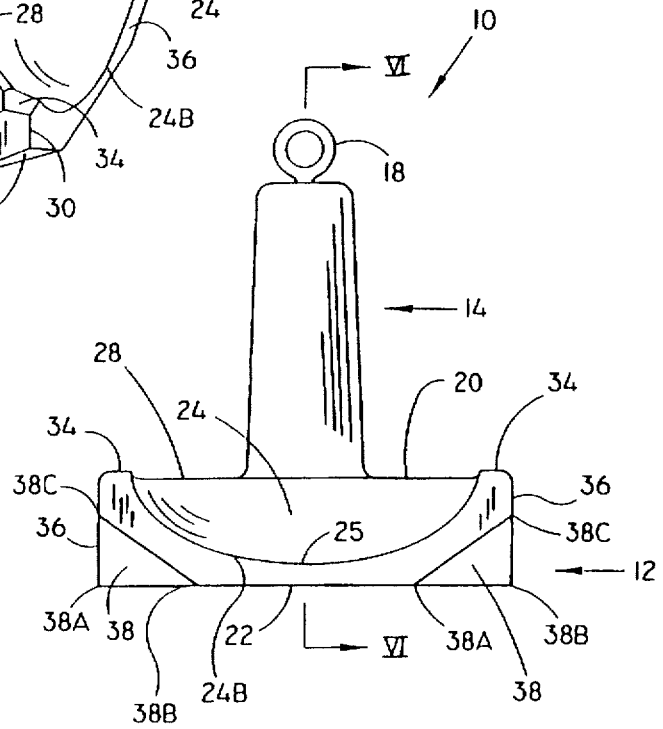
FIG. 2 is an elevational view of the anchor of FIG. 1 when viewed from a side.
Figure 3:
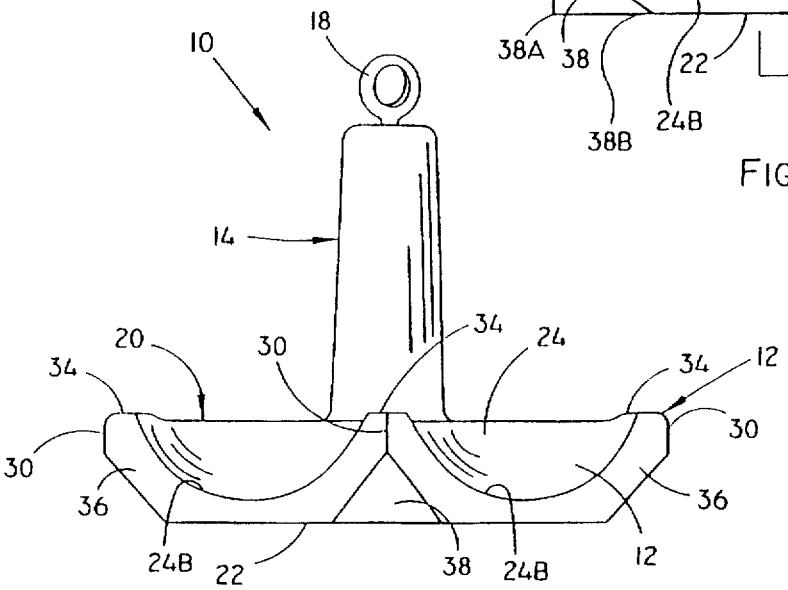
FIG. 3 is an elevational view of the anchor of FIG. 1 when viewed from a corner.
Figure 4:
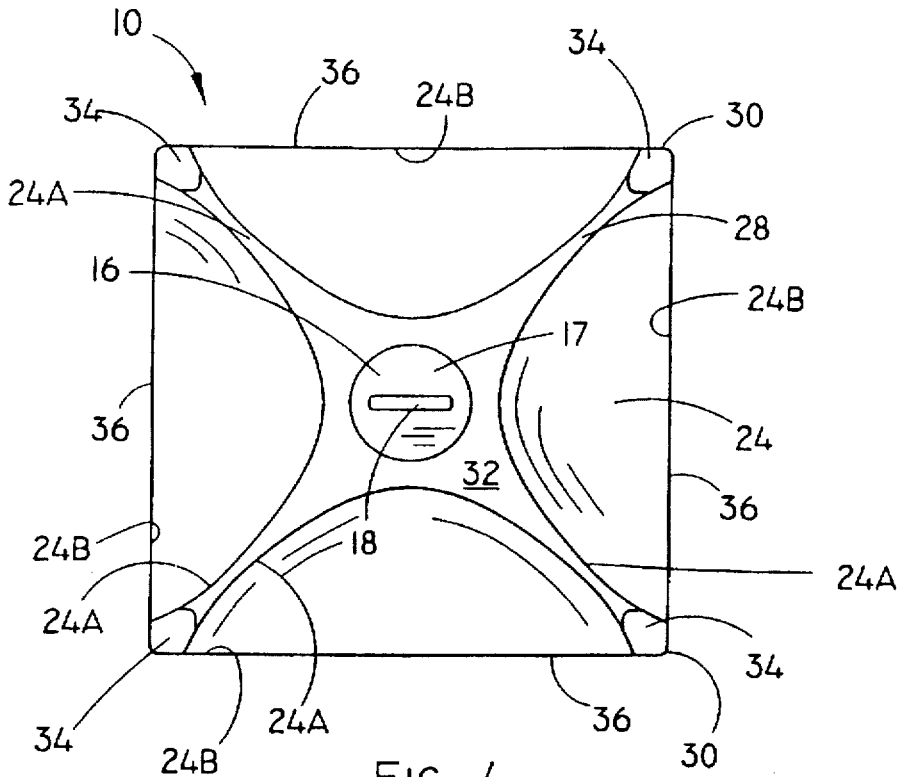
FIG. 4 is a top plan view of the anchor.
Figure 6:
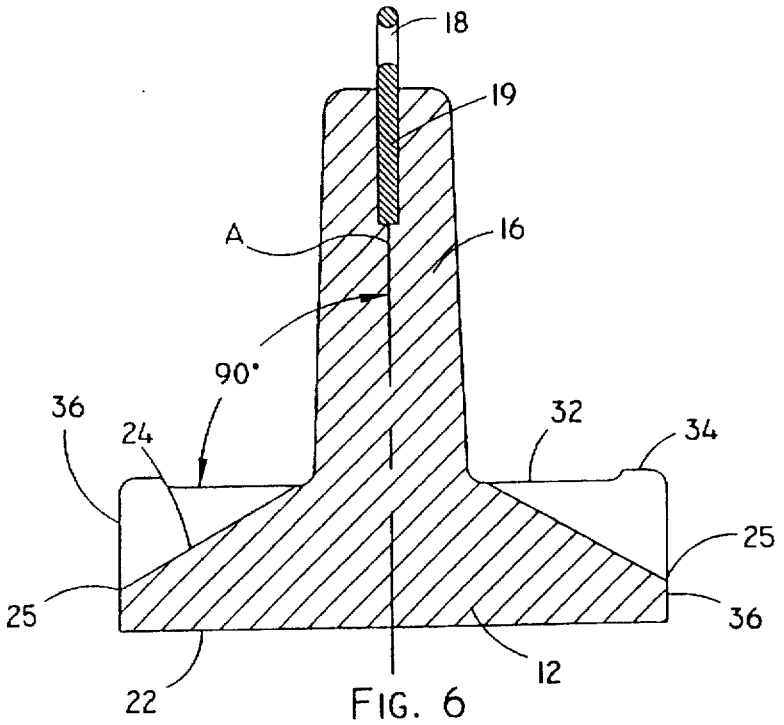
FIG. 6 is a sectional view taken along the line VI—VI of FIG. 2.

Base 12 includes a top surface 20, a generally planar bottom surface 22, and a plurality of sides 36 which, in the preferred embodiment, number four but can vary therefrom as would be understood by one skilled in the art. It is contemplated that base 12 could be circular with only a single side. Alternately, instead of four sides, base 12 may include two curved sides, three straight or curved sides, or five or more straight or curved sides. Top surface 20 includes a plurality of generally smooth scooping surfaces 24 which form a plurality of shovel-like, recessed or concave indentations in top surface 20. The number of scooping surfaces 24 preferably corresponds to the number of sides 36, but can independently vary, such as, for example, in the case of a circular base 12. Scooping surfaces 24 extend radially outwardly from the center of base 12 and end adjacent sides 36. Preferably, surfaces 24 each extend from a curved top edge **24*a* (FIGS. 1 and 4) to a curved lower edge 24*b* and slope downwardly from a top surface 32 to edge 24*b* at side 36. Depending on the number of sides 36, and the contour of those sides, i.e., straight or curved, edges 24*a*, 24*b* will alternately be straight or curved in various planes. As is best seen in FIG. 6, the depth of the shovel-like indentations formed by scooping surfaces 24 in base 12 generally increases with increasing radial distance from the center of base 12. The depth is preferably greatest adjacent a midpoint 25 in each of sides 36 (FIGS. 2 and 6). With scooping surfaces 24 configured in this manner, sides 36 and edges 24*b* essentially form the digging edge for "shovels" or "scoops" defined by scooping surfaces 24**.

The contour of scooping surfaces 24 corresponds to, in the illustrated embodiment, a segment of a cylinder having an axis which extends at an angle to, and meets, an extension of the axis of shaft 16. It will be understood, however, that scooping surfaces 24 may be contoured in a wide variety of different fashions. As a nonexhaustive list of alternative contours, scooping surfaces 24 may correspond to a segment of a sphere, may be a series of two or more planar segments forming one or more valleys in base 12, or may be some combination thereof. It is contemplated that any surface, or configuration of multiple surfaces, which functions in a shovel or scoop-like manner is within the scope of the present invention.

A plurality of ridges 28 between scooping surfaces 24 are defined in top surface 20 of base 12. The number of ridges 28 corresponds to the number of scooping surfaces and can vary in accordance therewith. Ridges 28 extend radially outwardly from the center of base 12 and terminate at a plurality of corners 30 defined by the conjunction of sides 36 with each other. Ridges 28 have top surfaces 32 which are, in the illustrated embodiment, substantially planar and extend at a right angle to the central axis A of connector shaft 16 as shown in FIG. 6. The width of ridges 28 varies with the radial distance from the center of base 12 and the shape of surfaces 24. Close to the center, ridges 28 are wide. Further from the center, the width of ridges 28 decreases, and near corners 30, the width increases again. A stepped apex 34 is disposed on each of ridges 28 adjacent corners 30. Stepped apexes 34 are substantially planar like ridges 28, but are offset or stepped up a slight elevation from top surfaces 32 of ridges 28. Stepped apexes 34 may alternatively be angled, or sharp on top, or otherwise configured.

In the preferred embodiment, base 12 is square shaped when viewed from above or below (FIGS. 4 and 5) and includes four, generally planar sides 36 which meet at corners 30. While in the preferred embodiment, sides 36 are illustrated as straight, it will be understood by those skilled in the art that as noted above, sides 36 may be otherwise shaped such as, but not limited to, arcuate, angled, or a combination thereof. As noted previously, it is within the scope of the present invention to provide an anchor with three sides, three corners, three radially extending ridges, and three shovel-like indentations between the ridges. Other variations in the number of sides are also contemplated.

Figure 5:
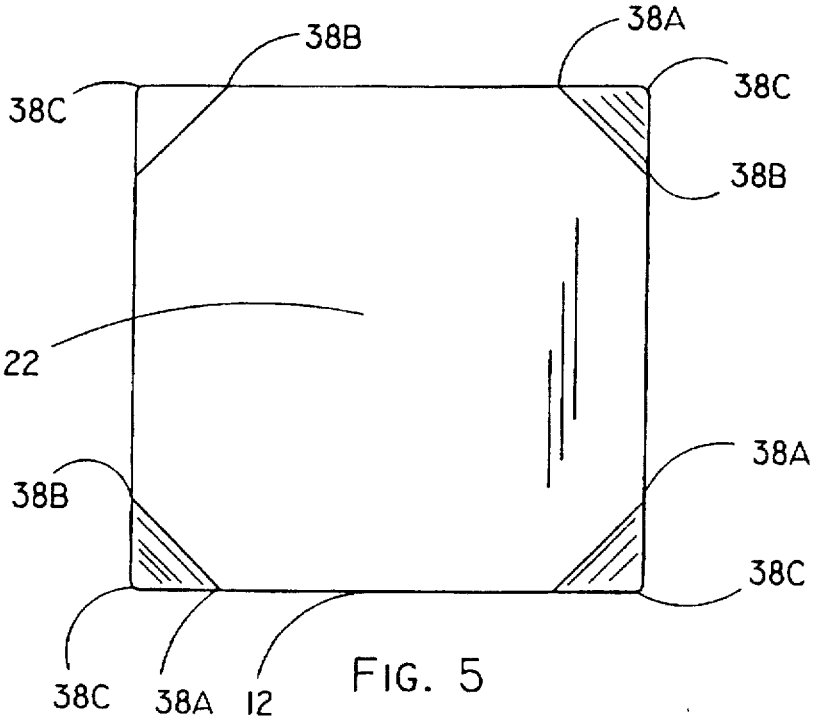
FIG. 5 is a bottom plan view of the anchor.

Underneath each corner 30 is an inclined surface 38 extending upward from bottom surface 22 to corner 30. In the preferred embodiment, inclined surfaces 38 are generally planar, triangularly shaped, and have three apexes **38*a*, 38*b* and 38*c*, two of which (38*a*, 38*b*) are adjacent bottom surface 22 and sides 36 and one of which (38*c*) is adjacent corner 30 (FIGS. 2 and 5). In the illustrated embodiment, bottom surface 22 is flat and generally planar. It is within the scope of the invention, however, to modify bottom surface 22** to be hollowed, grooved, rounded, ridged, knurled, or any other of a variety of configurations.

In the preferred embodiment, base 12 and connector 14 of anchor 10 are molded from cast iron. A shaft 19 of fastening element or eyelet 18 is inserted into connector shaft 16 during the molding process and can be made of any material suitable for being embedded in the cast iron during molding and strong enough to secure a line, as would be within the knowledge of one skilled in the art. In the preferred embodiment, fastening element 18 is metal such as steel or iron. After the anchor has been cast in one piece and cooled, the entire anchor is preferably dip coated with molten polyvinyl chloride to the desired thickness using conventional dip coating techniques. The coating is preferably ⅛ to 3/16 of an inch thick, but may be more or less, and some variations are expected at different areas of the anchor. The polyvinyl chloride coating is preferably black in color although other colors may be used, and fully coats anchor 10, including eyelet 18. Alternately, anchor 10 may be entirely coated with a powder coated epoxy. Anchor 10 may also be molded from material other than cast iron, as would be known by one skilled in the art. However, cast iron is sufficiently dense and heavy to allow anchor 10 to function properly by digging into any of a variety of commonly encountered bottom materials in various bodies of water including mud, sand, muck or marl, and the like.

Figure 7:
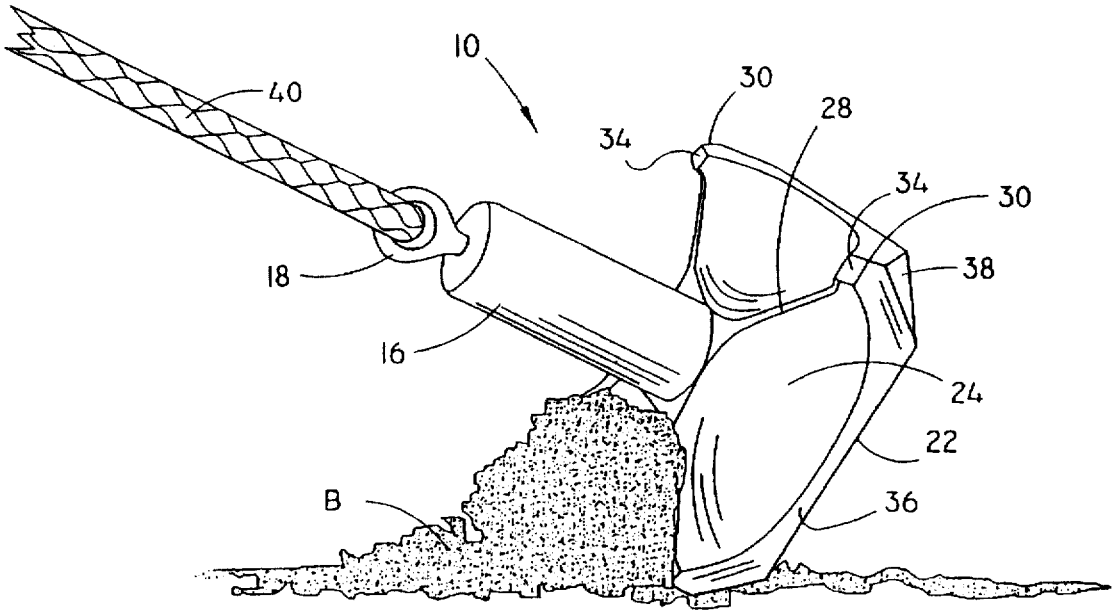
FIG. 7 is a perspective view of the anchor shown engaged with and digging into the bottom of a body of water.

When in use and secured by a line 40 to a boat, as shown in FIG. 7, anchor 10 provides improved anchoring capabilities because of the shovel-like indentations created by scooping surfaces 24 (FIG. 6). When anchor 10 rests on one of its sides 36, scooping surfaces 24 enable anchor 10 to dig into a lake bed bottom 42, or the like, while remaining at a more upright angle than many prior known anchors and without being tipped as much as in conventional anchors. It has been found that anchor 10 operates well at angles of between about 30° and 60° from the horizontal, preferably about 45°. The increased digging ability of anchor 10 improves its anchoring capability. When anchor 10 rests on surface 38 of one of its corners 30 instead of its sides 36 (not shown), ridges 28 in combination with apexes 34 and corners 20 act in a plow-like fashion. This plow-like function also serves to dig anchor 10 into lake bed or bottom B and thereby improves the anchoring capabilities of anchor 10. The concave shape of scooping surfaces 26 also ensures that debris, mud, or sand from the floor of the body of water slides easily off anchor 10 upon lifting or other movement through the water. The shallow conical shape of connector shaft 16 also enables anchor 10 to fit into and be stored in hollow anchor-keepers fastened on the boat.

Figure 8:
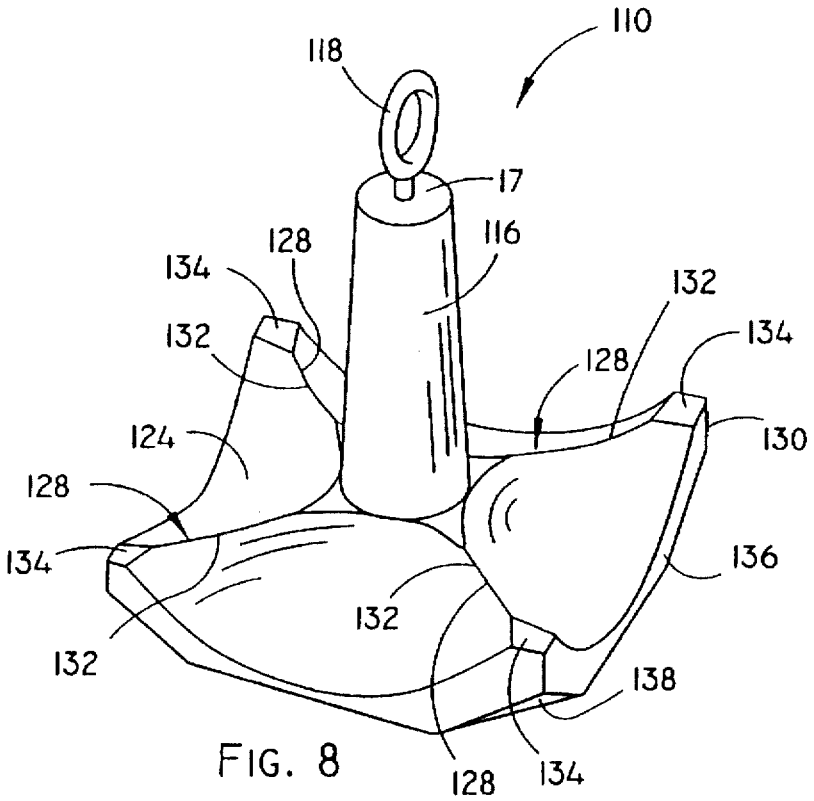
FIG. 8 is a perspective view of an anchor according to a second embodiment of the present invention.

FIG. 8 illustrates an alternate embodiment of an anchor 110 according to the present invention. Anchor 110 differs from anchor 10 primarily in that top surfaces 132 of ridges 128 are sharp, instead of flat as in anchor 10. Also, inward from stepped or offset apexes 134, top surfaces 132 are arcuate instead of generally horizontal.

Figure 9:
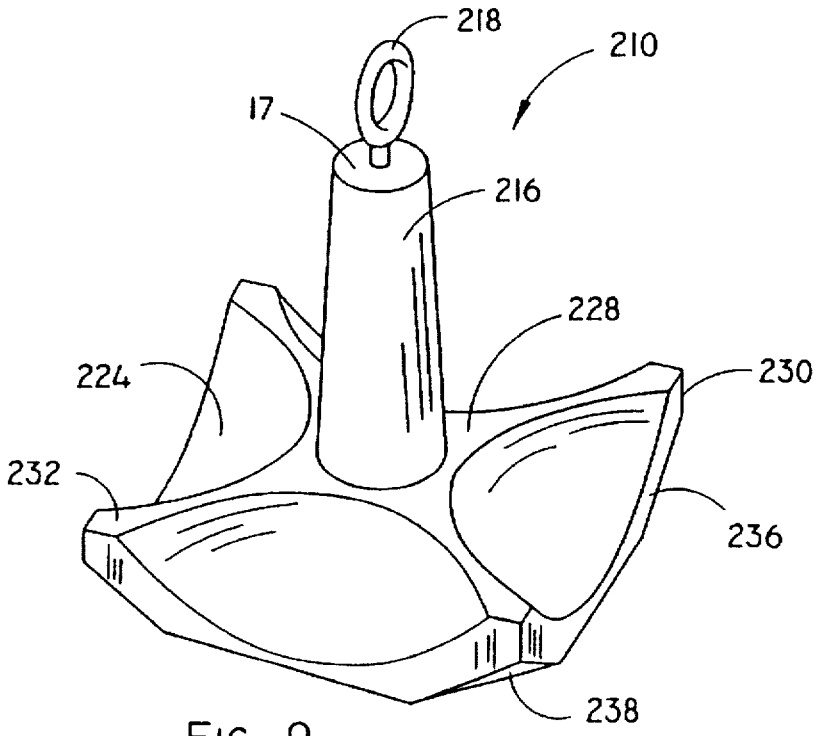
FIG. 9 is a perspective view of an anchor according to a third embodiment of the present invention.

FIG. 9 depicts still another embodiment of an anchor 210 according to the present invention. Anchor 210 differs from anchor 10 primarily in that it does not include stepped or offset apexes 34. Instead, ridges 228 are generally continuously flush with the center of base 212 to the corners 230 such that the entire surface is generally planar.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the appended claims.

The embodiments of the present invention in which an exclusive property or privilege is claimed are defined as follows:

1. An anchor, comprising:

a base having a top surface, a bottom surface, a plurality of side edges, and a center;

a plurality of ridges in said top surface extending radially outwardly from said center of said base, each of said ridges terminating at a position spaced from said center in an apex;

a plurality of recessed scooping surfaces defined on said top surface between said plurality of ridges, each of said scooping surfaces sloping outwardly and downwardly from said center to a respective one of said side edges; and a connector secured to said base and selectively engageable with an anchor line; said side edges and scooping surfaces enabling said anchor to dig into and be retained securely in the bottom of a body of water, and allowing debris to easily wash off said anchor upon movement through the water after being released from the bottom.

2. The anchor of claim 1 wherein said ridges have top surfaces which are flat.

3. The anchor of claim 1 wherein said base includes a plurality of sides which define said side edges and which meet each other at junctions to define corners at said junctions; said ridges terminating at said corners.

4. The anchor of claim 3 further including a plurality of triangular inclined surfaces which extend upwardly from the bottom surface of said base at an angle and terminate at apexes adjacent said corners.

5. The anchor of claim 3 wherein said connector includes an upwardly extending shaft disposed substantially in the center of said top surface of said base, said shaft having a top and a fastening element on said top defining an aperture engageable with an anchor line.

6. The anchor of claim 5 wherein said recessed scooping surfaces are generally smooth and concave.

7. The anchor of claim 5 wherein said base and said shaft are made from cast iron and said anchor is coated with a layer of polyvinyl chloride.

8. The anchor of claim 5 wherein said ridges have varying widths which increase adjacent said corners.

9. The anchor of claim 1 wherein each of said ridges includes a stepped apex which is offset from the surface of said ridge.

10. An anchor, comprising:

a base having a top surface and a bottom surface, said top surface having a center;

a plurality of shovel-like indentations in the top surface of said base extending radially outwardly from the center of the top surface, said shovel-like indentations having a depth in said base which increases along a radius of said base in a direction extending away from said center;

a plurality of ridges on said top surface defined between said shovel-like indentations, said plurality of ridges extending radially outwardly from the center of the top surface; and a connector secured to said base and selectively engageable with an anchor line.

11. The anchor of claim 10 wherein said ridges each have a top, said tops of said ridges being generally planar.

12. The anchor of claim 10 wherein said ridges each have a top and at least a portion of said tops of said ridges are arcuate.

13. The anchor of claim 10 wherein each of said ridges terminates at a position spaced from said center of the top surface in a stepped apex which is offset from said ridge.

14. The anchor of claim 10 wherein said base includes a bottom surface which is generally planar.

15. The anchor of claim 10 wherein said base further includes a plurality of sides, and a plurality of corners defined at the junction of said sides wherein said ridges terminate at said corners.

16. The anchor of claim 15 wherein said base further includes an inclined surface at each of said plurality of corners, each said inclined surface extending upwardly at an angle from said bottom surface of said base.

17. The anchor of claim 10 wherein said connector includes an upwardly extending shaft disposed substantially in the center of said top surface of said base, said shaft having a top and a fastener on said top engageable with an anchor line.

18. The anchor of claim 10 wherein each of said shovel-like indentations is a generally smooth, concave surface.

19. An anchor, comprising:

a base having a bottom surface, a top surface, a plurality of sides, and a plurality of corners defined at the junctions of said sides, said top surface having a center;

a plurality of concave recesses defined in said top surface which extend outwardly from said center to said sides, each said recess having a depth in said base which is greatest at said sides and between said corners;

a plurality of ridges in said top surface defined between said plurality of concave surfaces, said plurality of ridges extending outwardly from said center of said top surface and terminating at said corners;

a shaft disposed on said center of said top surface of said base, said shaft including an axis and a fastening element selectively engageable with a boat line; and said ridges extending generally at a right angle to said axis of said shaft.

20. The anchor of claim 19 wherein said ridges have tops which are generally planar.

21. The anchor of claim 20 wherein said ridges further include stepped apexes adjacent said corners and offset from said tops of said ridges.

22. The anchor of claim 21 further including an inclined surface at each corner, each said inclined surface extending upwardly at an angle from said bottom surface of said base to said corner.

23. The anchor of claim 22 wherein each said ridge has a width which increases at said corners.

24. The anchor of claim 22 wherein said base has four of said sides, four of said corners, four of said concave recesses, and four of said ridges.

25. The anchor of claim 24 wherein said base and said shaft are cast in one piece from iron and said anchor is coated with a layer of polyvinyl chloride.

* * * * *